US007424122B2

(12) United States Patent
Ryan

(10) Patent No.: US 7,424,122 B2
(45) Date of Patent: Sep. 9, 2008

(54) HEARING INSTRUMENT VENT

(75) Inventor: James G. Ryan, Ottawa (CA)

(73) Assignee: Sound Design Technologies, Ltd., Burlington, Ontario (CA)

( * ) Notice: Subject to any disclaimer, the term of this patent is extended or adjusted under 35 U.S.C. 154(b) by 488 days.

(21) Appl. No.: 10/818,258

(22) Filed: Apr. 5, 2004

(65) Prior Publication Data

US 2004/0218772 A1 Nov. 4, 2004

Related U.S. Application Data

(60) Provisional application No. 60/460,017, filed on Apr. 3, 2003.

(51) Int. Cl.
*H04R 25/00* (2006.01)

(52) U.S. Cl. ..... 381/322; 381/328; 381/380

(58) Field of Classification Search ..... 381/322, 381/328, 312, 318, 196, 324, 380, 317, 71.6, 381/72, 83, 93, 95, 309; 181/207, 224, 279–280, 181/129, 130, 135
See application file for complete search history.

(56) References Cited

U.S. PATENT DOCUMENTS

| | | | | |
|---|---|---|---|---|
| 4,311,206 | A | 1/1982 | Johnson | |
| 4,375,016 | A | 2/1983 | Harada | |
| 4,442,917 | A | 4/1984 | Johnson | 181/135 |
| 4,677,675 | A | 6/1987 | Killion et al. | |
| 5,195,139 | A | 3/1993 | Gauthier | 381/69 |
| 5,201,007 | A * | 4/1993 | Ward et al. | 381/328 |
| 5,373,555 | A | 12/1994 | Norris et al. | |
| 5,488,205 | A | 1/1996 | Major | |
| 5,689,573 | A * | 11/1997 | Jones | 381/338 |
| 6,973,994 | B2 * | 12/2005 | Mackin et al. | 181/156 |
| 7,079,662 | B2 * | 7/2006 | Niederdrank | 381/328 |
| 2002/0003888 | A1 * | 1/2002 | Budge | 381/345 |
| 2005/0016792 | A1 * | 1/2005 | Graefenstein | 181/253 |

FOREIGN PATENT DOCUMENTS

| | | |
|---|---|---|
| DE | 3927797 | 2/1991 |
| DE | 10213059 | 12/2003 |
| WO | WO 02/17680 A1 | 2/2002 |

OTHER PUBLICATIONS

MacRae, John; "Vents in High-Powered Hearing Aids;" The Hearing Journal; Jan. 1983, pp. 13-16.
European Search Report dated Apr. 5, 2006.

* cited by examiner

*Primary Examiner*—Huyen D Le
(74) *Attorney, Agent, or Firm*—Van Dyke, Gardner, Linn & Burkhart, LLP

(57) ABSTRACT

A vent configuration for a hearing instrument comprises a vent tube having a length and a vent opening, and at least one cell positioned around the periphery of the vent tube. The at least one cell is closed at a first inner end and open at an outer end, which is adjacent the vent opening. The cell is a tube that extends around the periphery of the vent tube along a portion of the length of the vent tube. A hearing instrument incorporating the vent configuration is also included.

23 Claims, 10 Drawing Sheets

HEARING INSTRUMENT VENT

CROSS-REFERENCE TO RELATED APPLICATION

This application claims priority to U.S. Provisional Application No. 60/460,017, filed on Apr. 3, 2003, the disclosure of which is incorporated herein by reference in its entirety.

FIELD

This technology relates to a hearing instrument. In particular, the technology concerns a vent for a hearing instrument.

BACKGROUND

Hearing instruments that are positioned inside the ear typically include a means for controlling the sound pressure inside the ear by venting pressure inside the ear canal. Typically, a vent in the form of a canal extending through the hearing instrument from outside the ear to inside the ear is utilized to relieve pressure in the ear canal. Venting to permit pressure equalization and to reduce the occlusion effect caused by a completely sealed ear canal is a known technique.

A prior art hearing instrument is depicted in FIG. 1 installed in an ear canal. The hearing instrument includes a vent in the form of an elongated tube that extends from an inner surface of the hearing instrument, inside the ear, to an outer surface of the hearing instrument, outside the ear. The hearing instrument includes an opening on the outer surface that is coupled to a microphone for receiving sound signals from outside the ear. A receiver is coupled electronically to the microphone and reproduces sound signals to the ear canal through an opening on the inner surface of the hearing instrument.

In many hearing instruments, sound energy escapes from inside the ear canal through the vent and leaks back to the hearing instrument microphone, causing acoustic feedback. This is an undesirable characteristic.

SUMMARY

A vent configuration for a hearing instrument comprises a vent tube having a length and a vent opening, and at least one cell positioned around the periphery of the vent tube along at least a portion of the length of the vent tube. The at least one cell is closed at an inner end, with each cell having an open end adjacent the vent opening.

The at least one cell may comprise a second tube surrounding the periphery of the vent tube. The second tube may extend a length that is less than the length of the vent tube. The second tube may comprise at least one web extending between an outer wall of the vent tube and an inner wall of the second tube. The at least one web may comprise two webs to define two cells in the second tube. The at least one web may comprise three webs to define three cells in the second tube. The at least one web may be substantially straight to define a substantially straight cell having a length equal to the length of the second tube. Alternatively, the at least one web may be wrapped around the vent tube along the length of the vent tube to define a spiral cell having a cell length that is greater than the length of the second tube. The at least one web may be wrapped around the vent tube at a wrapping angle $\theta$ and the total cell length may be $L/\sin\theta$.

The vent tube may propagate energy at a wavelength and the at least one cell may be configured to propagate energy at the same wavelength that is out of phase with the energy propagating from the vent tube. The cell is configured such that the energy propagating from the cell destructively interferes with the energy propagating from the vent to reduce the amount of energy propagating from the vent, which, in turn, reduces feedback. The vent configuration may also include a damping material associated with the vent opening and the open end of the at least one cell. The damping material may be a fine mesh nylon.

The at least one cell of the vent configuration may comprise a quarter wavelength resonance corresponding to a chosen frequency of sound. The open end of the at least one cell may have a surface area that is equal to or exceeds a surface area of the vent opening.

In another embodiment, a vent configuration for a hearing instrument comprises a vent tube having a length and a vent opening for allowing the propagation of energy at a wavelength, and feedback reducing means. The feedback reducing means is configured to propagate energy at the same wavelength as the wavelength of the vent tube energy, but is out of phase with the energy propagating from the vent tube. The feedback reducing means may be passive.

In yet another embodiment, a vent configuration for a hearing instrument comprises a vent tube and a passive frequency reducing mechanism associated with the vent tube.

In a further embodiment a hearing instrument comprises a body, the vent configuration discussed above extending through the body, a microphone positioned near one end of the body, a receiver positioned near another end of the body opposite the microphone end, and an amplifier positioned between the microphone and the receiver.

BRIEF DESCRIPTION OF THE DRAWING FIGURES

DETAILED DESCRIPTION

Figure 1:
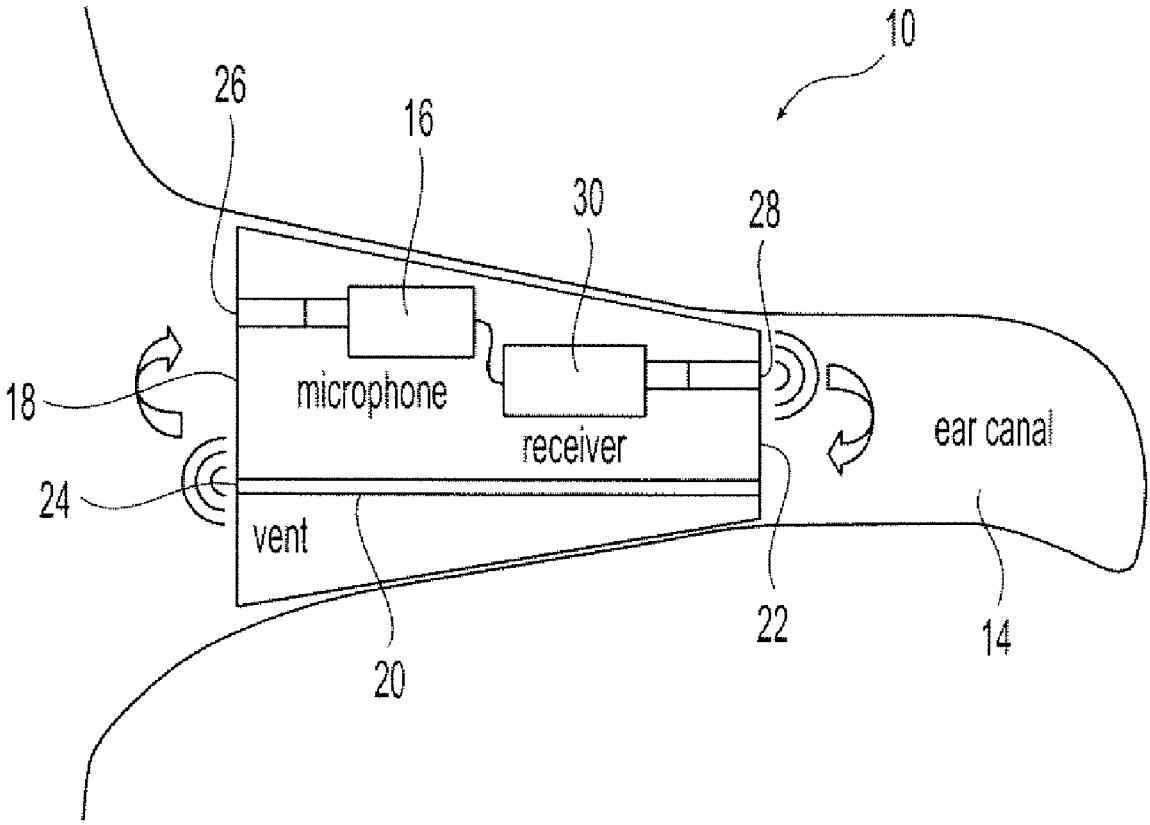
Fig. 1 (Prior Art)
FIG. 1 is schematic of a prior art hearing instrument installed in an ear canal of a user.
Figure 2:
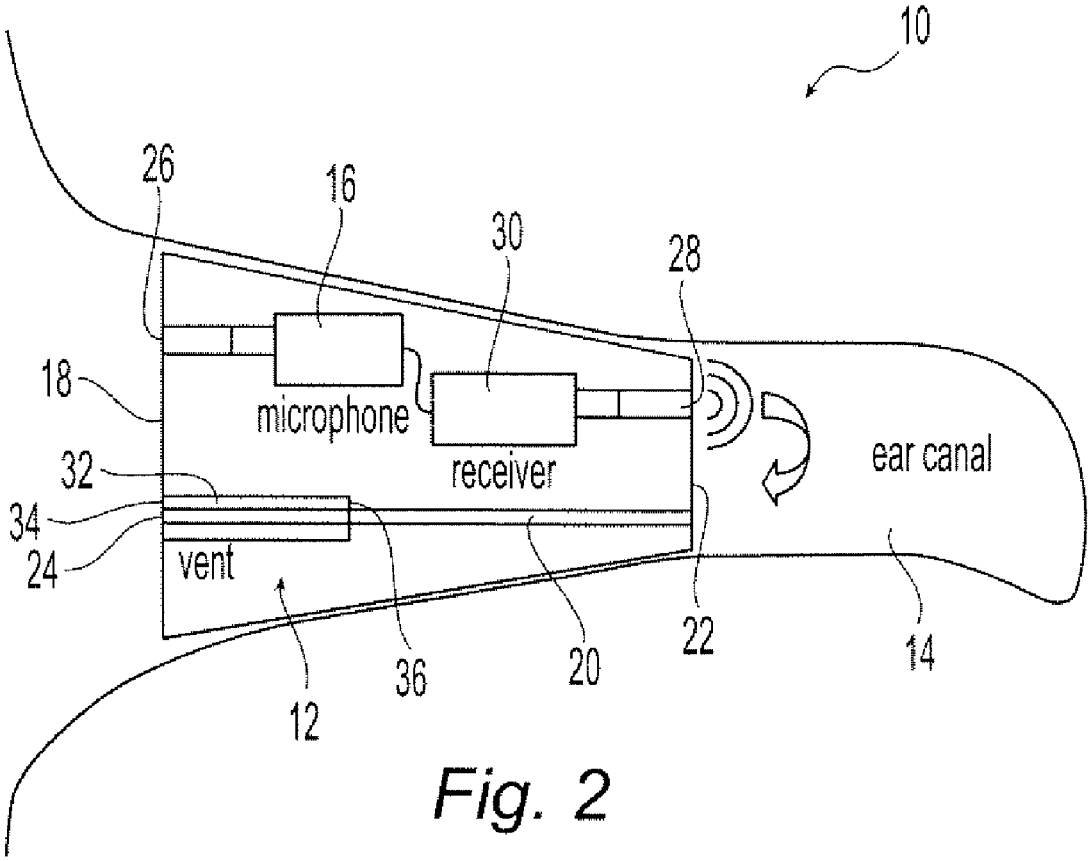
FIG. 2 is a schematic view of an example hearing instrument installed in an ear canal of a user.

The example vent configuration 10 for a hearing instrument 12 is designed to reduce the amount of acoustic signal that leaks from the ear canal 14 back to the hearing instruments microphone 16. An example vent configuration 10 that incorporates the example vent is depicted in FIG. 2. The vent configuration 10 includes an elongated vent tube 20 that extends through the vent configuration 10 from an inner side 22, positioned inside the ear canal 14, to an outer side or face plate 18, located outside the ear. The vent tube 20 includes an outlet port or opening 24 on the face plate 18 of the vent configuration 10. The vent configuration 10 also includes an outer opening 26 that is coupled to a microphone 16 and an inner opening 28 coupled to a receiver 30. The microphone 16 captures sound signals from outside the ear and communicates the sound signals to the receiver 30 via an amplifier (not shown). The receiver 30 reproduces the sound signals in the ear canal 14, often in an amplified or adjusted manner that allows the user to hear the sounds more efficiently or clearly.

FIGS. 3-6 and 15 depict the example vent configuration 10. The vent configuration 10 consists of a uniform-cross section length of vent tubing 20, as in a conventional vent configuration. The outlet port 24 of the tubing on the face plate 18 of the vent configuration 10 is surrounded by a series of cells or cavities 32 distributed around the periphery of the vent tube 20 for a given length. The cells 32 are positioned as a large diameter tube positioned around the smaller diameter vent tube 20. The cells 32 have an opening 34 on the face plate 18 surrounding the vent outlet port or opening 24, whereas the inner ends 36 of the cells 32, which are positioned inside the vent configuration 10, are acoustically sealed. The webbing 38, shown in FIGS. 3,4 and 15 prevents acoustical propagation around the circumference of the cells 32 and also provides mechanical stability for the structure. The vent configuration 10 is easy to manufacture with existing multi-lumen tubing. The cells 32 are designed to provide sound attenuation.

The open cells 32 are tuned a quarter wavelength resonance whose frequency is chosen by design to coincide with the frequency of maximum acoustic feedback through the vent 20. As a result, the vent configuration 10 is tunable for different devices. When feedback energy propagates down the vent tube 20 to the face plate 18 of the vent configuration 10, a portion of the energy propagates down the cells 32 and is reflected by the sealed end 36 of the cells 32. The reflection arrives out of phase with the vent radiation (travel time is two times a quarter wave). As a result, the total radiated acoustic energy is reduced or canceled by the quarter-wave cell resonance, thereby reducing acoustic feedback. It should be noted that it is not essential that the selected frequency coincide with the frequency of maximum acoustic feedback through the vent. It may be desired to tune the cells to a range of frequencies. The selected frequency may be dependent on the size of the hearing instrument. For example, it may not be possible to provide a cell length, due to size restrictions, to cancel feedback at a given frequency (such as a high frequency). However, it still may be advantageous to cancel feedback at a frequency range that is below the given frequency so that at least some feedback is reduced for the user.

The example vent configuration 10 reduces the sound radiation from the vent outlet port opening 24 using a passive structure. There is no need to decrease the forward gain of the hearing instrument, as with prior devices, and no additional power is consumed. The example vent design may also be used with other feedback reducing methods to achieve enhanced feedback suppression.

Figure 3:
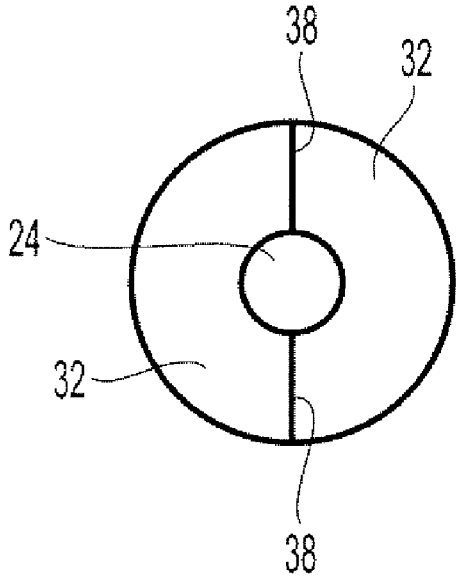
FIG. 3 is an end view of a first embodiment of an example vent configuration for a hearing instrument.
Figure 4:
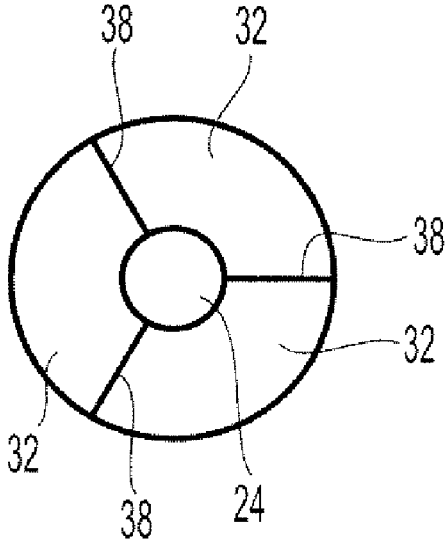
FIG. 4 is an end view of a second embodiment of an example vent configuration for a hearing instrument.
Figure 15:
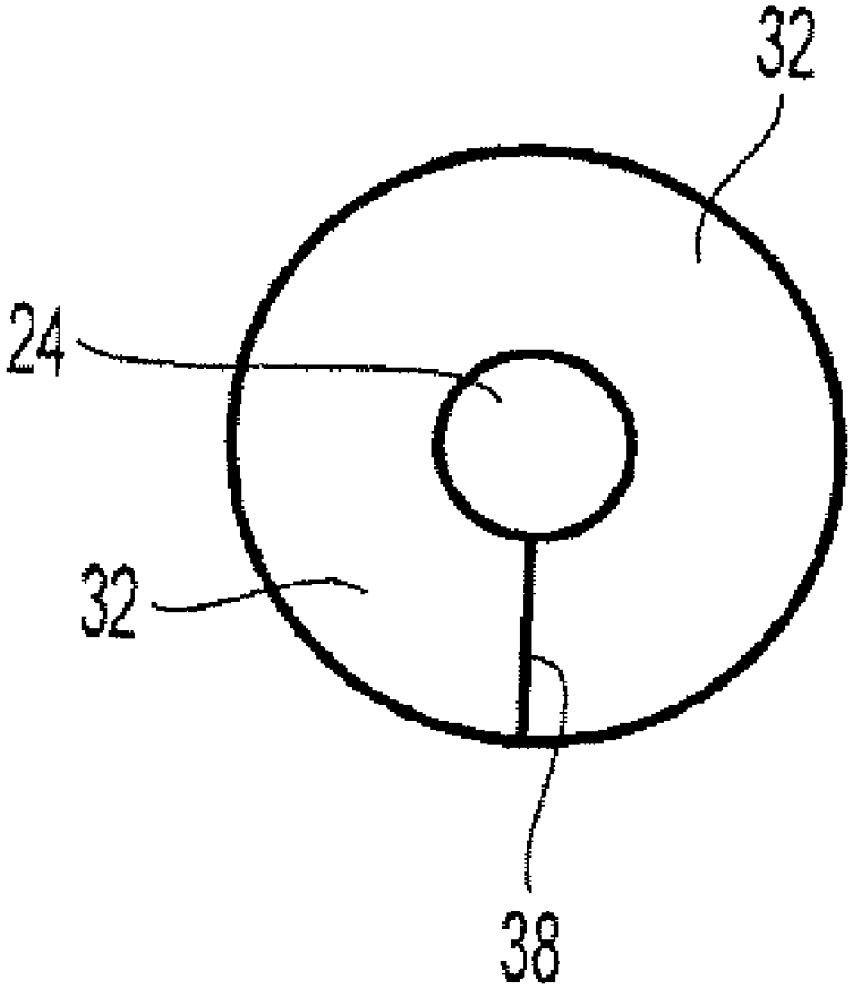
FIG. 15 is an end view of a further embodiment of an example vent configuration for a hearing instrument.

FIGS. 3,4 and 15 depict three different cross-sections for the series of cells 32 surrounding the vent tube 20. FIG. 15 shows one open cells 32, FIG. 3 shows two open cells 32, and Fig 4 shows three open cells 32.The exact number of cells 32,is not critical to the example vent configuration 10, but both the total amount of open surface area surrounding the vent tube 20, as well as the longest cross-sectional dimension must be determined to reduce feedback in a given frequency range. The total surface area of the cell openings 34 should exceed that of the vent opening 24 for feedback reduction. In addition, the circumference of the cells 32 should be smaller than the wavelength of the sounds for which reduction is desired, in order to reduce the risk of acoustical cross modes being created in the vent tubing. Additional webbing may be introduced to further reduce cross modes.

Figure 5:
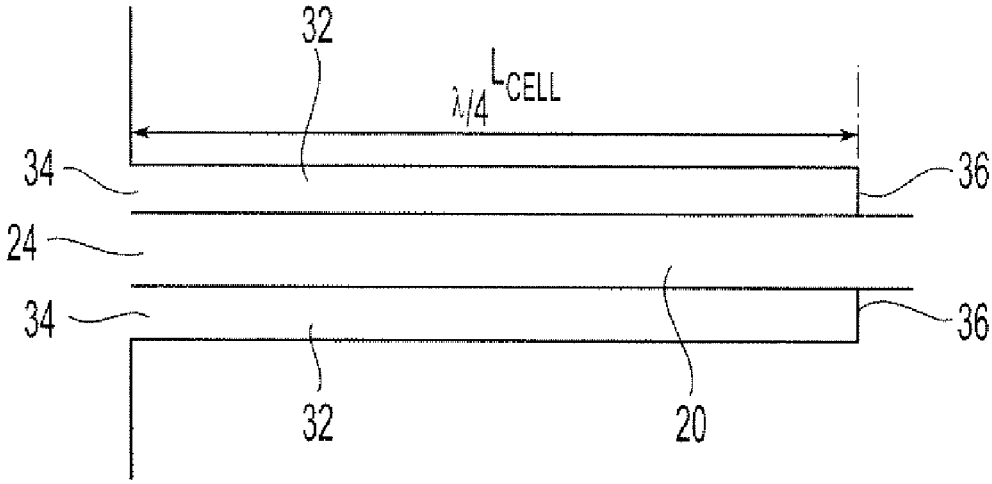
FIG. 5 is a schematic side view of an example vent configuration for a hearing instrument.

A cross-sectional view of the vent configuration 10 is shown in FIG. 5. As indicated the cell length $L_{cell}$ is at least one-quarter wavelength at the frequency for which feedback reduction is desired. Maximum feedback reduction will occur at the chosen frequency and will gradually diminish for frequencies up to approximately one octave above it. In addition, some feedback amplification is possible for frequencies below resonance.

Figure 6:
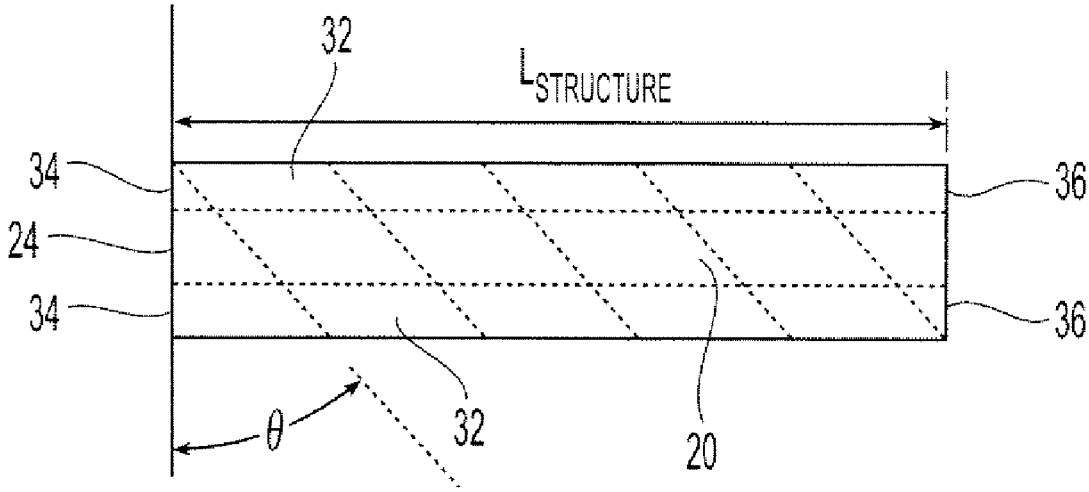
FIG. 6 is another schematic side view of an example vent configuration for a hearing instrument.

As depicted in FIG. 6, other types of non-straight cells 32 may be utilized with the example vent configuration 10. Since the acoustic wavelength is much larger than the cross-sectional dimensions of the vent outlet pot or opening 24 and the cell openings 34, acoustic propagation is substantially one-dimensional. Additional webbing can further reduce cross modes. Wrapping of cells in a spiral or other fashion around the vent tube increases cell length and propagates a lower resonant frequency. As a result, a non-straight cell configuration may result in space-saving for the confined space inside a vent configuration 10. This is advantageous where the cell length $L_{cell}$ needed for a feedback reduction frequency indicates a need for a cell 32 longer than the available vent tube 20. As shown in FIG. 6, one way to utilize a non-straight cell 32 is to wrap the cell 32 around the vent tube 20 in a spiral fashion. For a wrapping angle of θ, $$\text{total cell length}=L_{structure}/\sin\theta.$$

As an alternative for a given cell length, the vent configuration 10 may be made smaller by wrapping the cells 32 around the vent tube 20. This can result in a space savings inside the hearing instrument 12. Lower frequencies will typically require longer cell lengths. Therefore, it is advantageous to be able to bend the cells 32, as discussed above, to accommodate a large range of feedback cancellation.

Other physical packaging arrangements are also possible.

EXAMPLES

Figure 7:
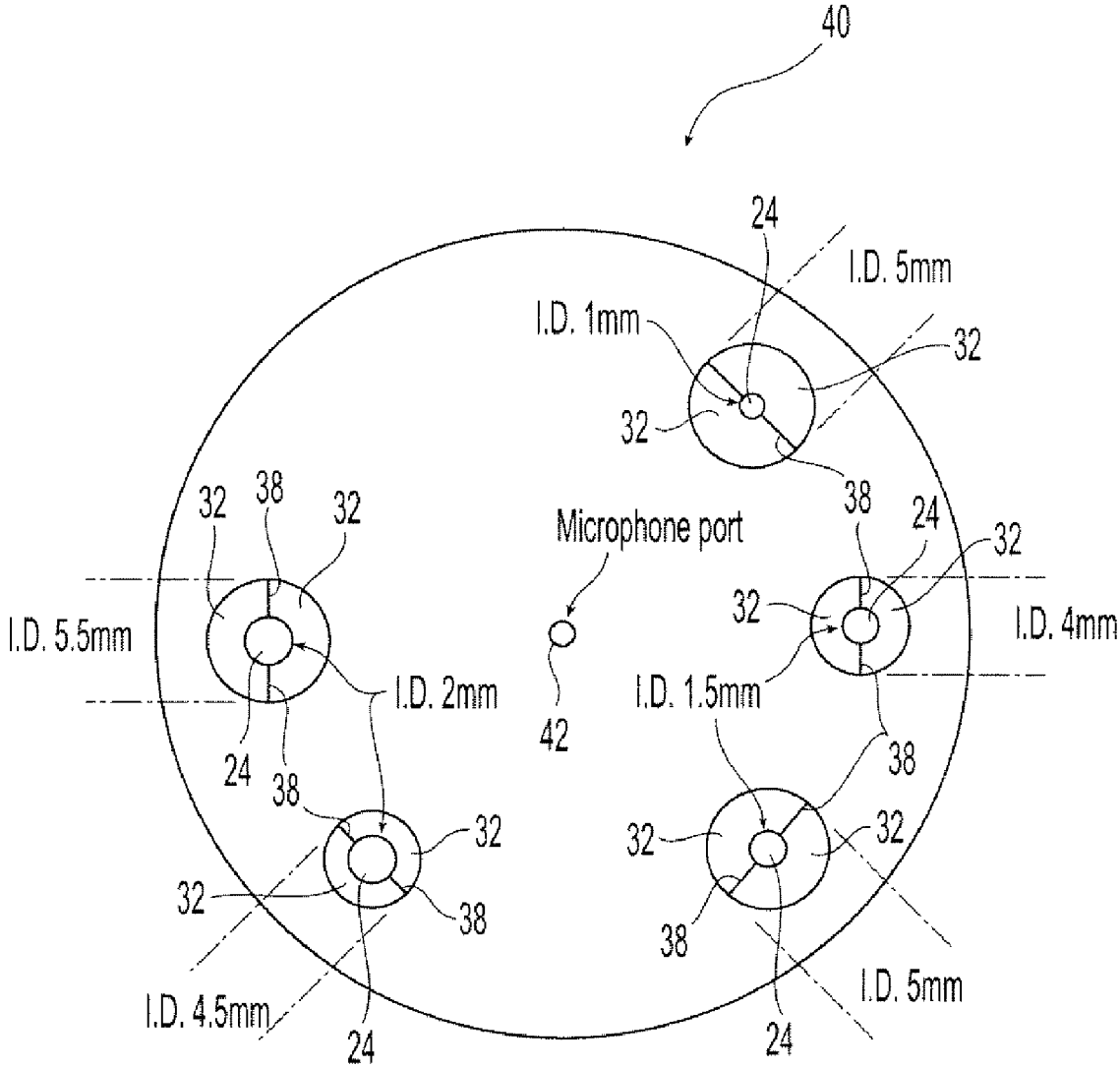
FIG. 7 is a prototype that was utilized in testing the example vent configuration.

Vent configurations 10 incorporating the concepts described herein are discussed below. A prototype 40 was utilized to test three vent diameters, including 1 mm, 1.5 mm, and 2 mm vents. The 1 mm vent was tested with a 5 mm inside diameter for the surrounding cells 32. The 1.5 mm vent was tested with both a 4 mm and 5 mm inside diameter for the surrounding cells 32. The 2 mm vent was tested with both a 4.5 mm and 5.5 mm inside diameter for the surrounding cells 32. An example of the prototype 40 used for testing is depicted in FIG. 7. A small hole 42 for a measuring microphone was also provided at a central position on the prototype 40. Testing was performed in order to determine what length of cells 32 correspond with the frequency of maximum acoustic feedback and to choose the ratio of large-tube cross-sectional area to small-tube cross-sectional area.

Figure 8:
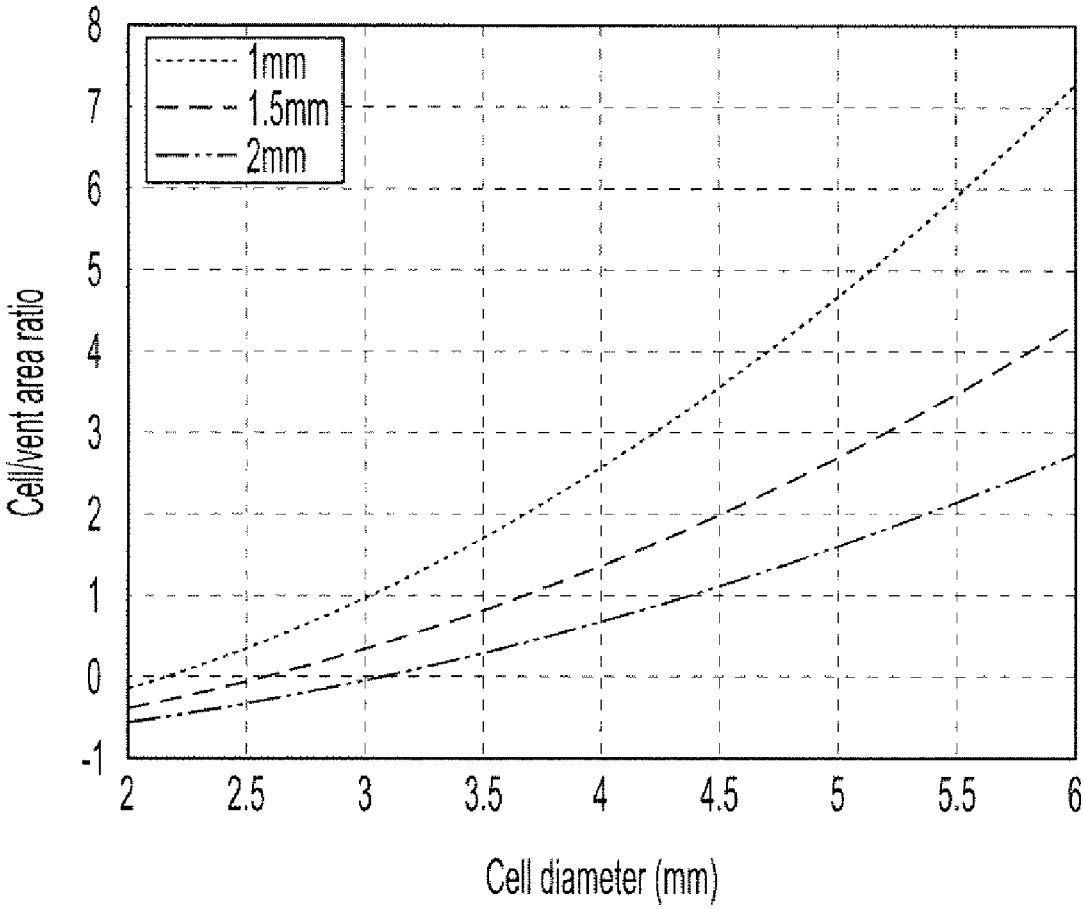
FIG. 8 is a graph depicting the relationship between cell/vent area ratio to cell diameter.

The prototype 40 was made of plastic and included, for each vent tube 20, an outer tube having a cell length of 3 cm to provide feedback attenuation around 3 kHz. (The actual parts that were fabricated resulted in a length of 2.7 cm, which corresponds to an actual peak frequency that was slightly higher.) Cell diameters were chosen with reference to the chart in FIG. 8. Tests utilizing the prototype 40 were conducted in an anechoic chamber. The various vent configuration 10 were closed cells and open cells 32.

Figure 9:
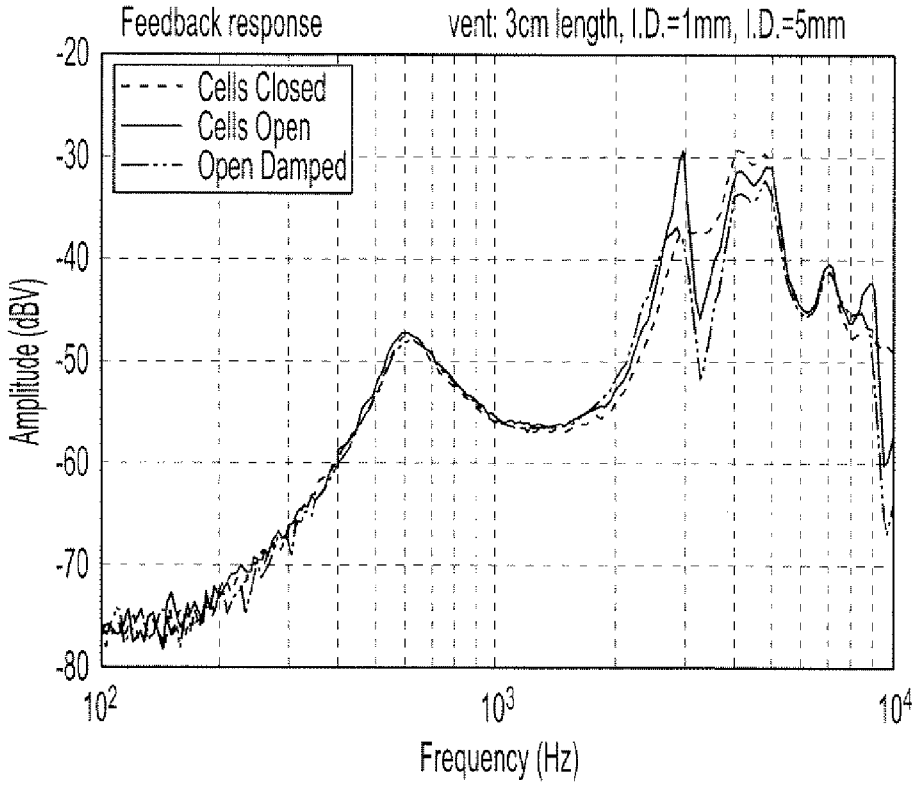
FIG. 9 is a graphical representation of the feedback response from an example vent configuration.
Figure 10:
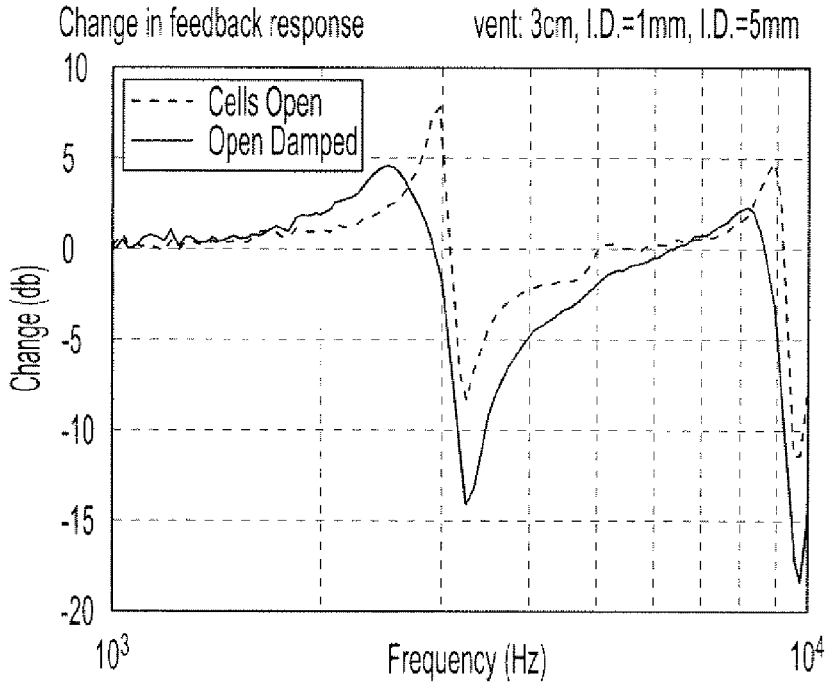
FIG. 10 is a graphical representation of the change in feedback response for an example vent configuration.

The measurement for the prototype 40 having a 1 mm/5 mm system is depicted in FIGS. 9 and 10. FIG. 9 represents actual microphone voltage observed during the tests and contains the response of the receiver 30, tubing 20 and microphone 16. The graph in FIG. 9 shows three curves: cells closed (conventional vent tube), cells open and damped. A small amount of damping material (a single layer of industrial tissue paper) was found to substantially improve performance at frequencies just below cell resonance. The damped curve represents the results of applying damping across the vent opening 24 with open cells 32.

Figure 11:
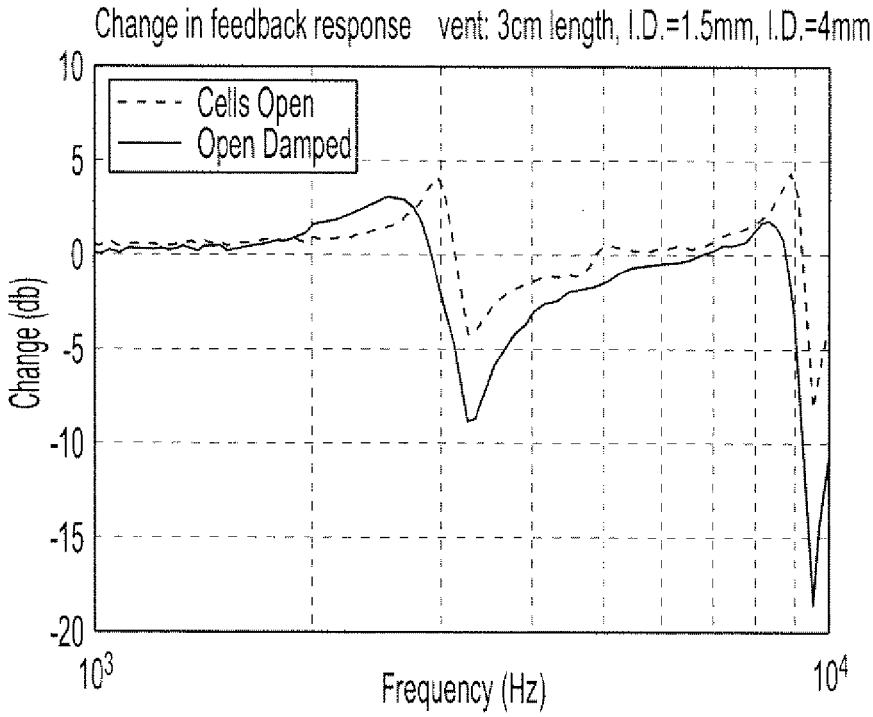
FIG. 11 is a graphical representation of the change in feedback response for another example vent configuration.
Figure 12:
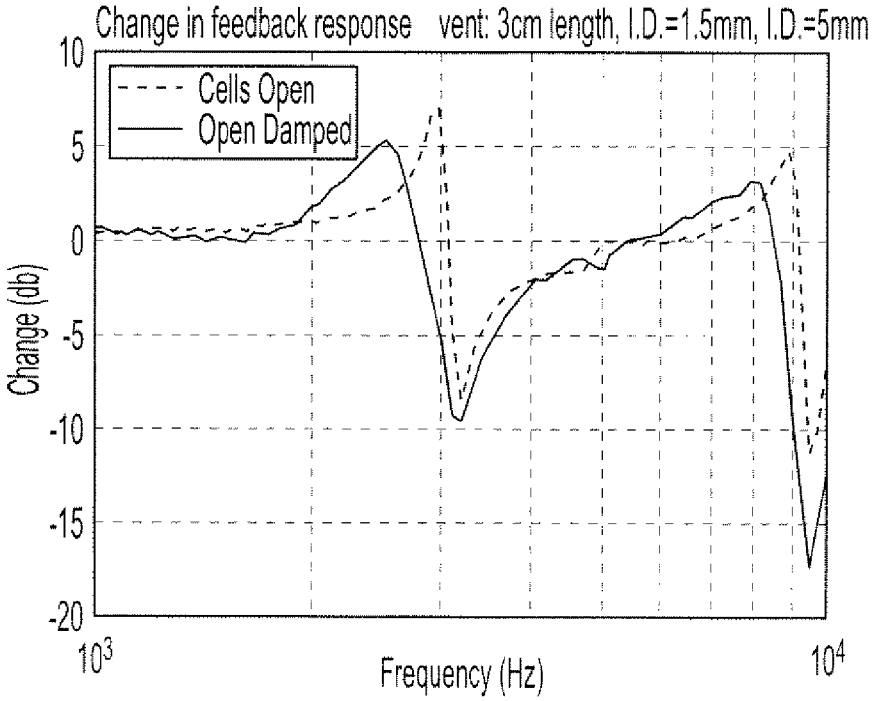
FIG. 12 is a graphical representation of the change in feedback response for yet another example vent configuration.
Figure 13:
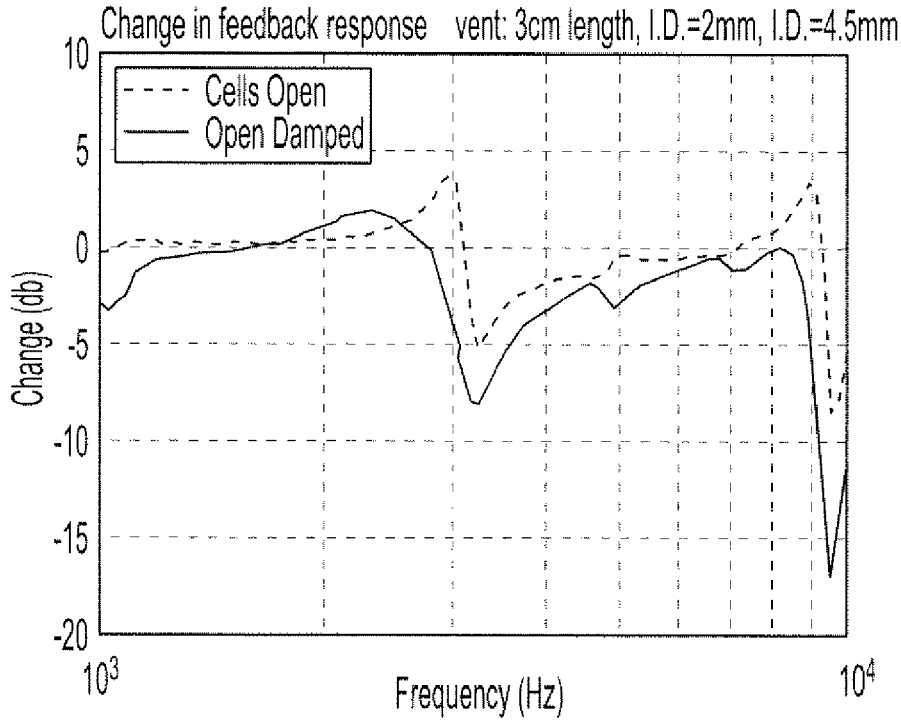
FIG. 13 is a graphical representation of the change in feedback response for a further example vent configuration.
Figure 14:
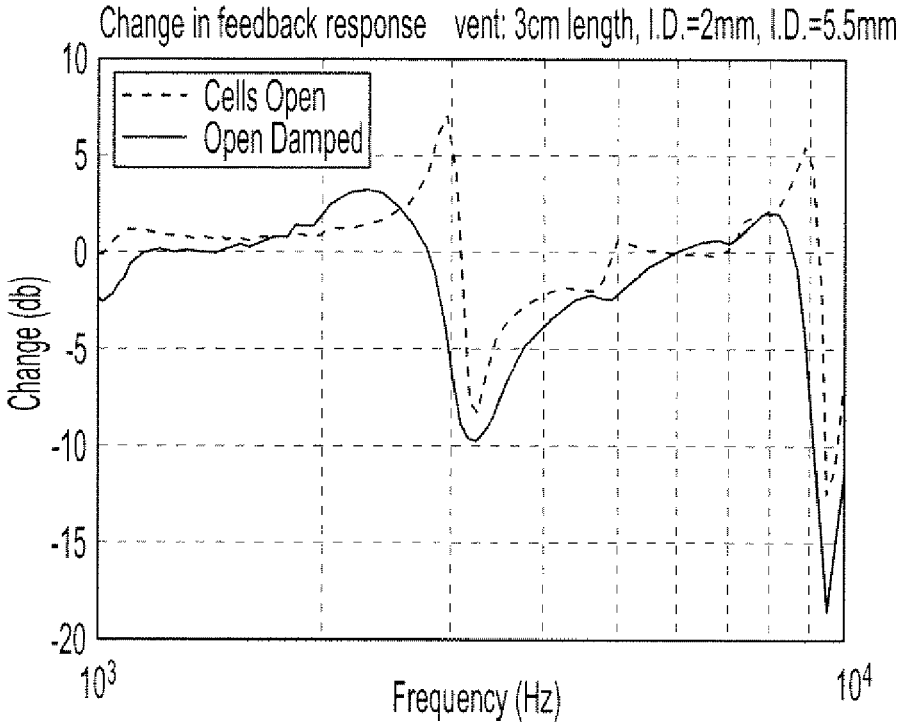
FIG. 14 is a graphical representation of the change in feedback response for another example vent configuration.

FIG. 10 represents the closed-cell measurement (corresponding to a conventional vent) subtracted from the open-cell data for a 1 mm/5 mm configuration. To shown the change in decibel level resulting from utilizing the example vent configuration 10 in a damped and undamped manner. FIG. 11 represents the change in decibel level resulting from utilizing a 1.5 mm/4 mm configuration. FIG. 12 represents the change in decibel level resulting from utilizing a 1.5 mm/5 mm configuration. FIG. 13 represents the change in decibel level resulting from utilizing a 2 mm/4.5 mm configuration. FIG. 14 represents the change in decibel level resulting from utilizing a 2 mm/5.5 mm configuration.

Figure 16:
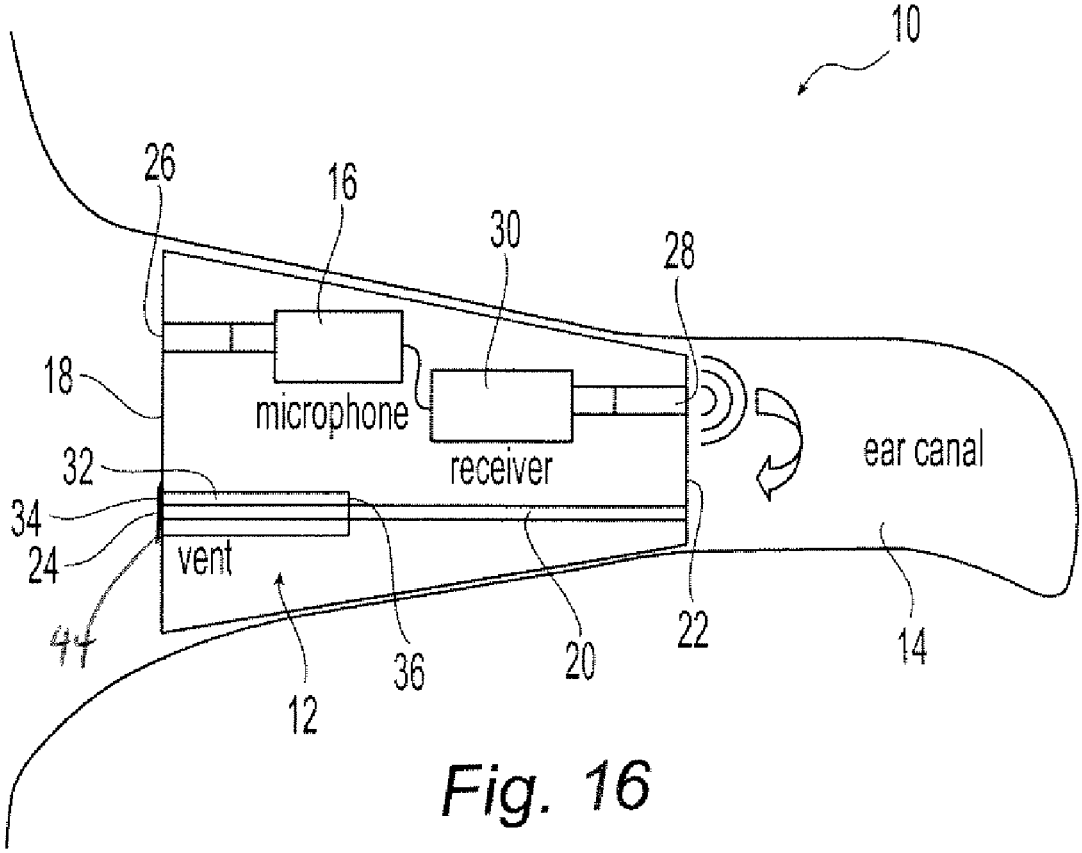
FIG. 16 is a schematic view of an example hearing instrument like that of FIG. 2 with a damping material installed.
Figure 17:
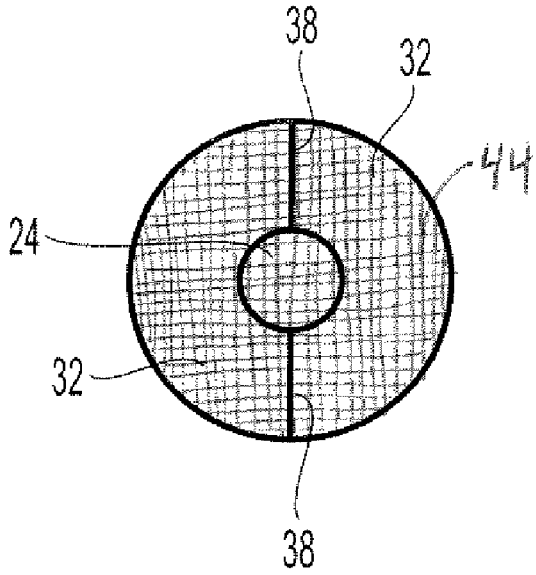
FIG. 17 is an end view of the hearing instrument of FIG.16 with the damping material installed.

The example vent configuration 10 provided feedback reductions for frequencies at or up to one octave above the cell resonant frequency (maximum observed was 13.8 db). Feedback enhancement was also observed for frequencies below cell resonance (maximum observed was 7.8 db). Acoustical damping 44, such as that depicted in FIGS. 16 and 17, improved the performance of the cells 32. The greatest reduction in feedback was obtained when the ratio of cell area to vent area was greatest. The peak feedback reduction (minimum of each curve) occurred at approximately 3.2 kHz. The maximum feedback reduction was obtained for combinations having the largest ratio of cell to vent area. A maximum feedback increase of 4.4 db occurred at a frequency of 2.5 kHz. Therefore, the bandwidth of feedback reduction extended over an octave from 3 to 6 kHz. Larger cell/vent area ratios produced greater reductions in feedback response and more feedback amplification (degradation) below resonance. The acoustical damping material 44 may be attached in any manner, as known by those of skill in the art, and may be, for example, a fine nylon mesh or industrial tissue paper in the form of a tape, as shown in FIGS. 16 and 17. Alternatively, as known by those of skill in the art, the damping material may be a wool or fibrous material inserted into cells.

Hearing instruments 12 are typically custom made for each individual user to suit a given range of hearing loss. The example vent configuration 10 can be manufactured in a number of different ways. One way is to utilize a sintering laser to form the vent tube 20 and cells 32 using a computer generated laser sintering process. Another way is to provide an opening in a hearing instrument 12 for the insertion of different vent configurations 10 in the hole. In this manner, each vent configuration 10 may be configured to reduce feedback at a given frequency. Other manufacturing techniques may also be utilized.

The term "substantially", as used herein, is an estimation term.

While various features of the claimed invention are presented above, it should be understood that the features may be used singly or in any combination thereof. Therefore, the claimed invention is not to be limited to only the specific embodiments depicted herein.

Further, it should be understood that variations and modifications may occur to those skilled in the art to which the claimed invention pertains. The embodiments described herein are exemplary of the claimed invention. The disclosure may enable those skilled in the art to make and use embodiments having alternative elements that likewise correspond to the elements of the invention recited in the claims. The intended scope of the invention may thus include other embodiments that do not differ or that insubstantially differ from the literal language of the claims. The scope of the present invention is accordingly defined as set forth in the appended claims.

What is claimed is:

1. A vent configuration for an in-the-ear hearing instrument that seals an ear canal of a user, said hearing instrument having an inner side positioned inside the ear canal of a user and a face plate located outside the ear canal of a user, said vent configuration comprising:

a vent tube having a length and a vent opening, said length extending from the inner side of the hearing instrument to the face plate of a hearing instrument and said vent opening being located in the vicinity of said face plate; and at least one tubular cell surrounding the periphery of said vent tube adjacent the face plate of the vent tube along at least a portion of the length of the vent tube and being closed at a first end that is spaced from said face plate, with each cell having an open end adjacent the vent opening.

2. The vent configuration of claim 1, wherein the at least one cell forms a second tube surrounding the periphery of the vent tube, said second tube extending a length that is less than the length of the vent tube.

3. The vent configuration of claim 2, wherein the second tube comprises at least one web extending between an outer wall of the vent tube and an inner wall of the second tube.

4. The vent configuration of claim 3, wherein the at least one web comprises two webs to define two cells in the second tube.

5. The vent configuration of claim 3, wherein the at least one web comprises three webs to define three cells in the second tube.

6. The vent configuration of claim 3, wherein the at least one web is substantially straight to define a substantially straight cell having a length equal to the length of the second tube.

7. The vent configuration of claim 3, wherein the at least one web is wrapped around the vent tube along the length of the vent tube to define a spiral cell having a cell length that is greater than the length of the second tube.

8. The vent configuration of claim 7, wherein the hearing instrument has a structure with a length and the at least one web is wrapped around the vent tube at a wrapping angle $\theta$ and the total cell length equals the length of the structure of the hearing instrument divided by $\sin\theta$.

9. The vent configuration of claim 1, wherein the vent tube propagates energy at a wavelength and the at least one cell is configured to propagate energy at the same wavelength that is out of phase with the energy propagating from the vent tube, with the energy from the at least one cell destructively interfering with the energy from the vent tube to reduce feedback.

10. The vent configuration of claim 1, further comprising a damping material associated with the vent opening and the open end of the at least one cell.

11. The vent configuration of claim 10, wherein the damping material is fine mesh nylon.

12. The vent configuration of claim 1, wherein the at least one cell comprises a quarter wavelength resonance corresponding to a chosen frequency of sound.

13. The vent configuration of claim 1, wherein the open end of the at least one cell has a surface area that is equal to or exceeds a surface area of the vent opening.

14. A hearing instrument comprising: a body; the vent configuration of claim 1 extending through the body; a microphone positioned near one end of the body; a receiver positioned near another end of the body opposite the microphone end; and an amplifier positioned between the microphone and the receiver.

15. A vent configuration for a hearing instrument comprising:

a vent tube having a length and a vent opening for allowing the propagation of feedback sound waves through said vent tube from an ear canal of a user of the hearing instrument to ambient air external to the user's ear canal; and passive feedback reducing means for propagating sound waves that are out of phase with a particular frequency of the feedback sound waves within the vent tube such that the amplitude of the feedback sound waves at the particular frequency are reduced, said particular frequency being based upon a physical dimension of said passive feedback reducing means, and said passive feedback reducing means having an end open to the ambient air external to the user's ear canal.

16. The vent configuration of claim 15, wherein the physical dimension is a depth of a cell adjacent said vent opening.

17. A hearing instrument comprising: a body; the vent configuration of claim 15 extending through the body; a microphone positioned near one end of the body; a receiver positioned near another end of the body opposite the microphone end; and an amplifier positioned between the microphone and the receiver.

18. A vent configuration for an in-the-ear hearing instrument having an inner side positioned inside the ear canal of a user and a face plate located outside the ear canal of a user, said vent configuration comprising:

a vent tube having a vent opening in the vicinity of the face plate, said vent opening exposed to ambient air external to the ear canal of the user; and a passive feedback attenuator positioned around at least part of the vent tube, said passive feedback attenuator separated from said vent tube by a wall surrounding said vent tube, and said passive feedback attenuator also being exposed to ambient air external to the ear canal of the user.

19. A hearing instrument comprising: a body; the vent configuration of claim 18 extending through the body; a microphone positioned near one end of the body; a receiver positioned near another end of the body opposite the microphone end; and an amplifier positioned between the microphone and the receiver.

20. A hearing aid adapted to be inserted in an ear canal of a user, said hearing aid comprising:

a body having a first side open to the atmosphere and a second side for positioning in the user's ear canal;

a vent tube defined within said body and passing from said first side to said second side such that air inside the user's ear canal is in fluid communication with the atmosphere via said vent tube; and a cell defined adjacent to said vent tube and separated from said vent tube by a wall, said cell including first and second ends wherein said first end is defined adjacent said first side of said body and is open to the atmosphere, and said second end is defined internally within said body and is closed.

21. The hearing aid of claim 20 further including a second cell defined adjacent to said cell, said second cell having a first end open to the atmosphere and a second closed end defined internally within said body.

22. The hearing aid of claim 20 wherein said cell is adapted to reduce the amplitude of feedback sound waves propagating through said vent tube in a manner in which the reduction of the amplitude of the feedback waves peaks at a particular frequency.

23. The hearing aid of claim 22 wherein the particular frequency is based on a depth of the cell within said body.

* * * * *